US005241339A

United States Patent [19]

Marany

[11] Patent Number: 5,241,339

[45] Date of Patent: Aug. 31, 1993

[54] FILM PROCESSOR FOR X-RAY FILM

[75] Inventor: William J. Marany, Williston Park, N.Y.

[73] Assignee: Air Techniques, Inc., Hicksville, N.Y.

[21] Appl. No.: 953,470

[22] Filed: Sep. 29, 1992

[51] Int. Cl.[5] ..... G03D 3/13

[52] U.S. Cl. ..... 354/319; 354/321; 354/338; 354/331

[58] Field of Search ..... 354/319-324, 354/331

[56] References Cited

U.S. PATENT DOCUMENTS 3,712,206 1/1973 Schmidt ..... 354/321
3,882,525 5/1975 Zwettler ..... 354/316
4,125,852 11/1978 Brooks ..... 354/322
4,760,417 7/1988 Zwettler et al. ..... 354/321

*Primary Examiner*—D. Rutledge
*Attorney, Agent, or Firm*—Louis E. Marn

[57] ABSTRACT

There is disclosed an automatic X-ray film processor assembly comprised of a drive assembly for the film transport unit including intermittently operated film lifters for passing film more rapidly through processing units thereby ensuring more uniform processing times as well as permitting facile changes in processing times. Additionally, there is provided a film chip withdrawal assembly at a point intermediate the film processing as well as a channel for readmitting any such intermediate processed film chip into the processor for completion of film processing.

19 Claims, 5 Drawing Sheets

FILM PROCESSOR FOR X-RAY FILM

BACKGROUND OF THE INVENTION

1) Field of the Invention

This invention relates to a film processing assembly, and more particularly, to an improved film assembly for a film processor for automatically processing X-ray film chips at reduced processing times.

2) Description of the Prior Art

There are many instances when the frequent processing of batches of exposed X-ray film chips is necessary, one of these being in a dentist's office. Since the time of the dentist and his assisting nurse is taken up with caring for the patient, it is not only inconvenient, but sometimes impossible for them to attend to the development of such film chips. There is thus a need for apparatus to automatically develop batches of X-ray film chips in a dentist office as quickly as possible and with a minimum of supervision on the part of the dentist or his assisting nurse.

In U.S. Pat. No. 3,882,525 to Zwettler, there is disclosed a processor for developing batches of dental X-ray film chips including a film transport unit comprised of a pair of laterally-disposed, vertically-spaced, parallel walls forming a continuously curved channel with three loops. The downwardly extending curved portions of the loops respectively extend into tanks in the development compartment of the processor. A lower lifter is mounted to rotate in each downwardly-extending curved portion of the continuous channel, and an upper lifter is mounted to rotate in each upwardly extending curved portion of the continuous channel. The inside surfaces of the pair of walls are provided with opposing v-grooves which form a path for engaging the opposite edges of a vertically-disposed film chip. The film chip is permitted to drop by gravity along the downwardly-extending portions of its path and is lifted by the lower and upper rotating lifters along the upwardly extending portions of its path.

In U.S. Pat. No. 4,760,417 also to Zwettler, there is disclosed an improved portable roll film processor for automatically processing roll film wherein a removable film drive module is provided for moving the film through tanks containing chemical processing liquids. The film drive module defines an essentially serpentine path for the film including successive "U"-shaped sections depending from a common frame member. Each of the "U"-shaped sections extends into a different tank and includes a down path leg for carrying the film into the tank and an up path leg for carrying the film out of the tank. All moving parts required to move the film are located above the liquids to minimize maintenance problems.

While such film processors effectively developed X-ray film chips, the film drive assemblies resulted in variable processing times as well as varying processing conditions. Generally, the rate of rotation of the upper arms to "slow rates" to allow the body of the film, when being driven by the "slow" lower arms, to pass through the area swept by the upper arms. This results in a loss of time between the time the film exits the liquid in one tank and enters the liquid in the next tank under the influence of the "slow" upper arms. Additionally, the "slow" lower arm results in a reduced submerged time for the leading edge of the film than the trailing edge and thus, unequal processing along the longitudinal direction of the film.

OBJECT OF THE PRESENT INVENTION

An object of the present invention is to provide a film drive assembly for an automatic film processor permitting of variable and faster processing time.

Another object of the present invention is to provide a film drive assembly for an automatic film processor permitting of more uniform processing.

Yet another object of the present invention is to provide a film drive assembly for an automatic film processor permitting of facile changes in processing conditions.

Still another object of the present invention is to provide a film drive assembly for an automatic film processor permitting of more rapid transport between processing steps.

SUMMARY OF THE INVENTION

These and other objects of the present invention are achieved in an automatic X-ray film processor assembly comprised of a drive assembly for the film transport unit including intermittently operated lifters for passing the film chips from each tank through succeeding processing units, thereby ensuring more uniform processing time, as well as permitting facile changes in processing times. Additionally, there is provided a film chip withdrawal assembly at a point intermediate film processing as well as a channel for readmitting any such intermediate processed film chip into the processor for completion of film processing.

BRIEF DESCRIPTION OF THE DRAWINGS

Further objects and advantages of the present invention will become apparent from the following detailed description when taken with the accompanying drawings, wherein.

DETAILED DESCRIPTION OF THE PRESENT INvENTION

Prior to a detailed description of the present invention, the basic film chip processor is disclosed in the aforementioned patents and will be described with reference to FIGS. 1 and 3 of the drawings to provide a setting for the detailed description of the present invention.

Figure 1:
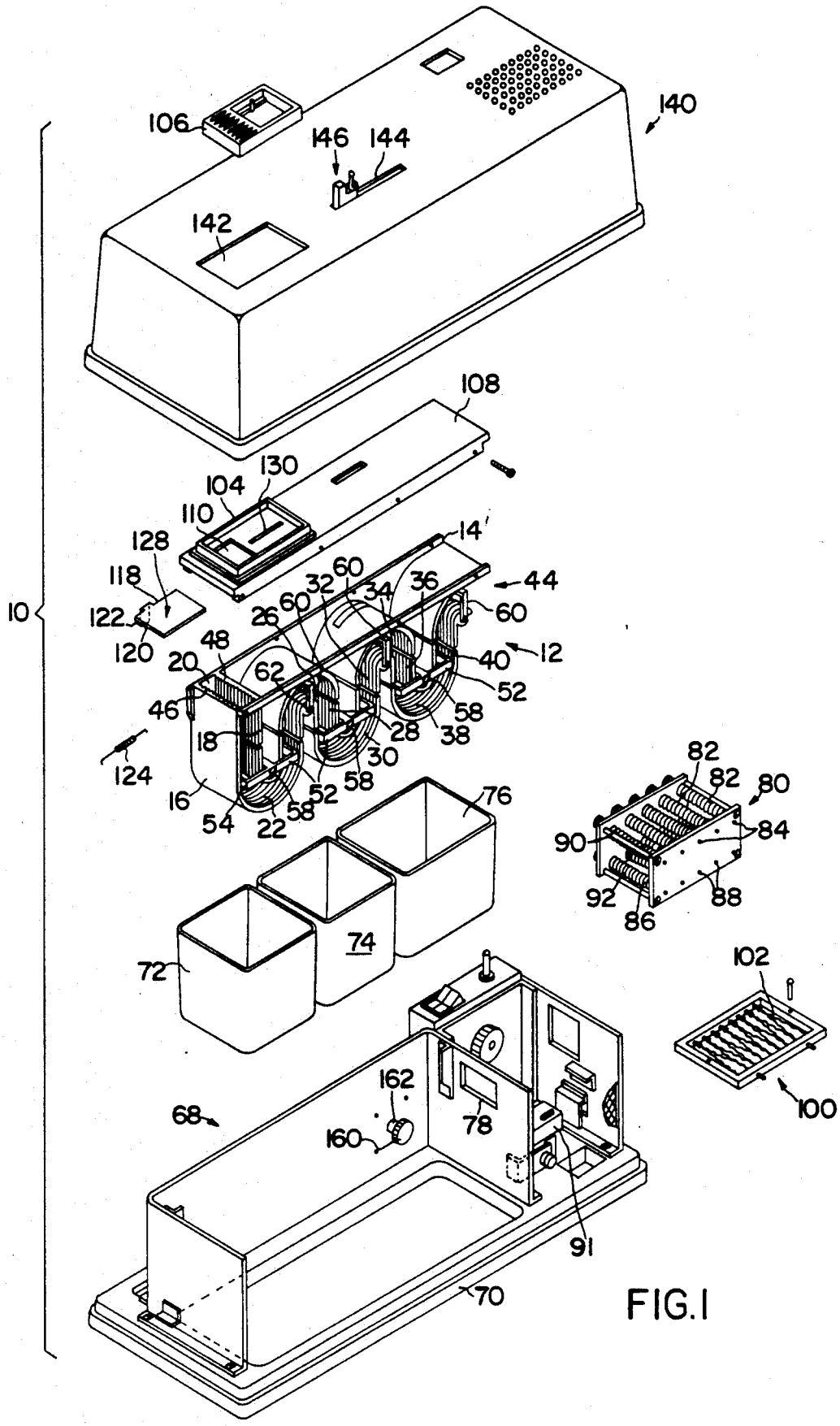
FIG. 1 is an exploded view of the components forming the film processor of the present invention.

Referring now more particularly to FIG. 1, component parts of the film chip processor, generally indicated as 10, include a film chip transport unit, generally indicated as 12, comprised of a molding having a vertical rear wall 14 with laterally-extending spaced, parallel, outer and inner curved walls 16 and 18, respectively, forming a channel with three downwardly-extending open loop portions. The channel formed by the outer and inner walls 16 and 18 comprises a vertical entrance passage 20 leading down into a first lower semicircular portion 22 which curves up into a vertical portion 24 leading into a first upper semicircular portion 26. The upper semicircular portion 26 then curves down into a vertical portion 28 leading down into a second lower semicircular portion 30 which curves up into a vertical portion 32 leading into a second upper semicircular portion 34. The second upper semicircular portion 34 then curves down into a vertical portion 36 leading into a third lower semicircular portion 38 which curves up into a vertical portion 40 leading into an upper quarter circular portion 42 that leads into a horizontal exit passage 44, as more clearly illustrated in FIG. 3.

The opposing lateral surfaces of the channel formed by the outer and inner curved walls 16 and 18 each have ten V-grooves 46 and 48, respectively, extending along the length thereof as more fully hereinafter discussed. Each pair of opposing V-grooves 46 and 48 serves to engage opposite edges of a small flexible vertically disposed film chips 50 (FIG. 3) to be advanced through the film chip transport unit 12.

Three lower lifters 52, each having radially-extending arm members 54 including laterally-extending arm portions 56, are mounted to rotate about the axes of their respective shafts 58 disposed at the center of each of the lower semicircular portions 22, 30 and 38 of each channel. Three upper lifters 60, each having radially-extending arm member 62, including laterially-extending arm portions 63, are respectively mounted to rotate about the axes of their respective shafts 64 disposed at the center of each of the upper semicircular portions 26, 34 and the quarter circular portion 42 of the last section of the channel. The lower and upper lifters 52 and 60 cooperate to move the film chips 50 along the rising portions of the V-grooved paths formed by the channel.

Figure 4:
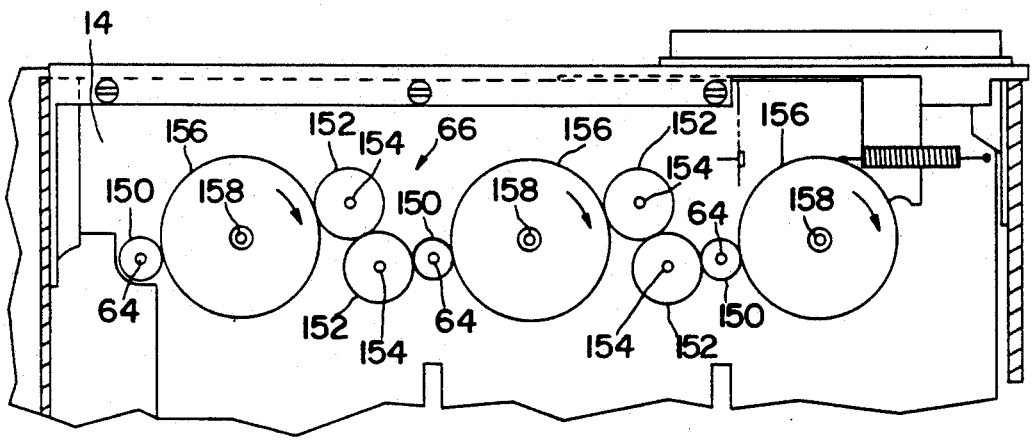
FIG. 4 is a partial rear sectionally elevational view of the gear frame of the film transport unit taken along the line 4—4 of FIG. 6.
Figure 6:
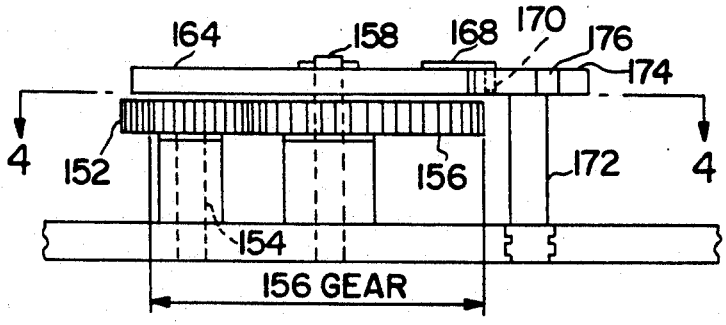
FIG. 6 is an enlarged bottom elevational view of a drive gearing assembly for the lower lifter.

As shown in FIG. 4, and as more fully hereinafter described, a gear train, generally indicated as 66, is provided on the vertical rear wall 14 of the transport unit for rotating the lower lifters 52 and the upper lifters 60.

When the transport unit 12 is lowered into an inner housing, generally indicated as 68 referring again to FIG. 1, which is mounted on a base 70, the lower semicircular portions 22 and 30 and 38 thereof, respectively, fit into the three tanks 72, 74 and 76 and the exit passage 44 of the channel is aligned with the entrance opening 78 into the drying compartment on the right end of the inner housing 68. A roller drive unit, generally indicated as 80, located in the drying compartment includes five transversely disposed upper rollers 82 rotatable on respective shafts 84 and five transversely disposed lower rollers 86 rotatable on respective shafts 88. The vertically-spaced upper and lower rollers 82 and 86 are formed with ten V-grooves 90 and 92, respectively.

Figure 3:
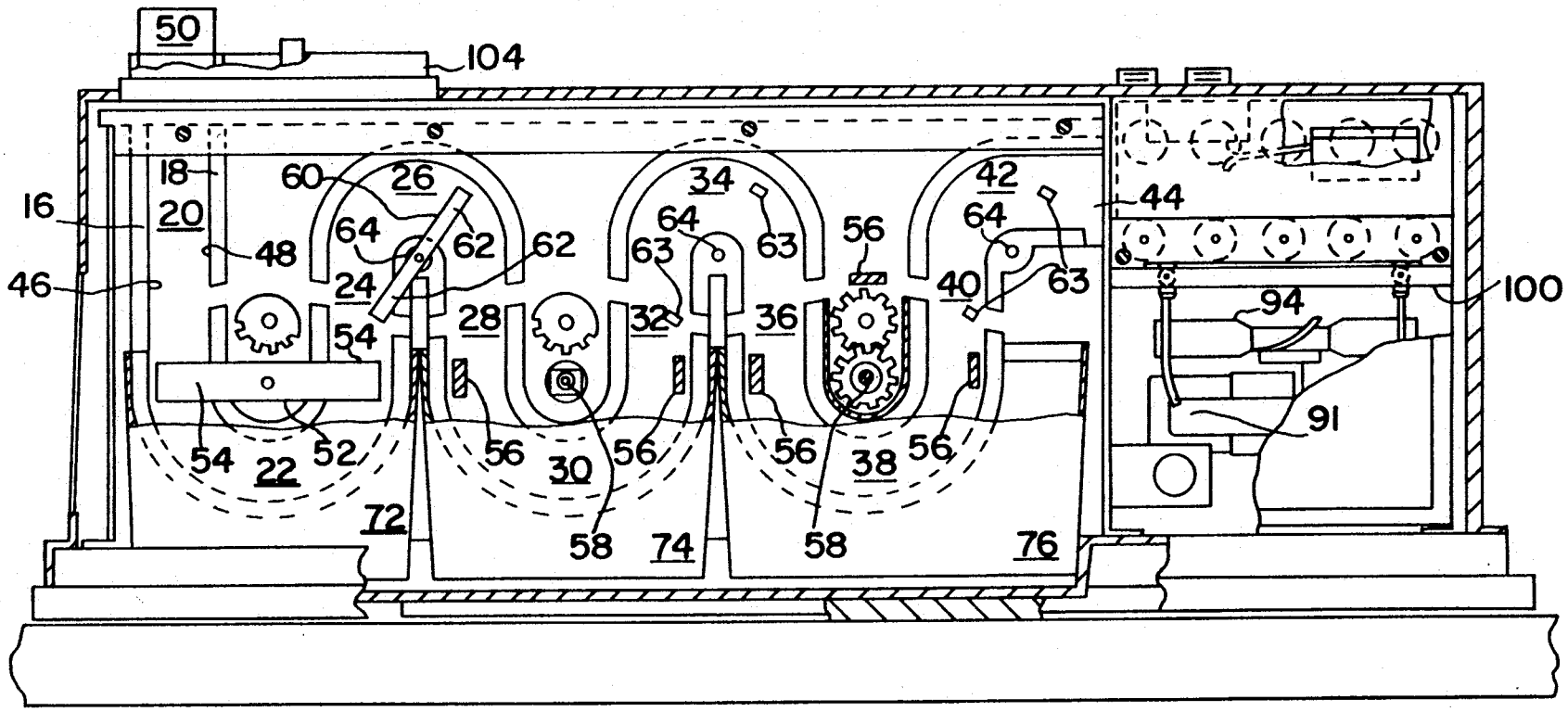
FIG. 3 is a front elevational view partially cut away, of the film processor of the present invention.

Mounted on the base of the drying compartment below the roller drive unit 80 is a motor 91 which drives a fan 94 (FIG. 3). A heater device 100 having a plurality of heating coils 102 extending thereacross is positioned above the fan 94. Thus, as the film chips 50 are advanced through the roller drive unit 80, they are dried by the hot air blown therepast by the fan 94.

Figure 2:
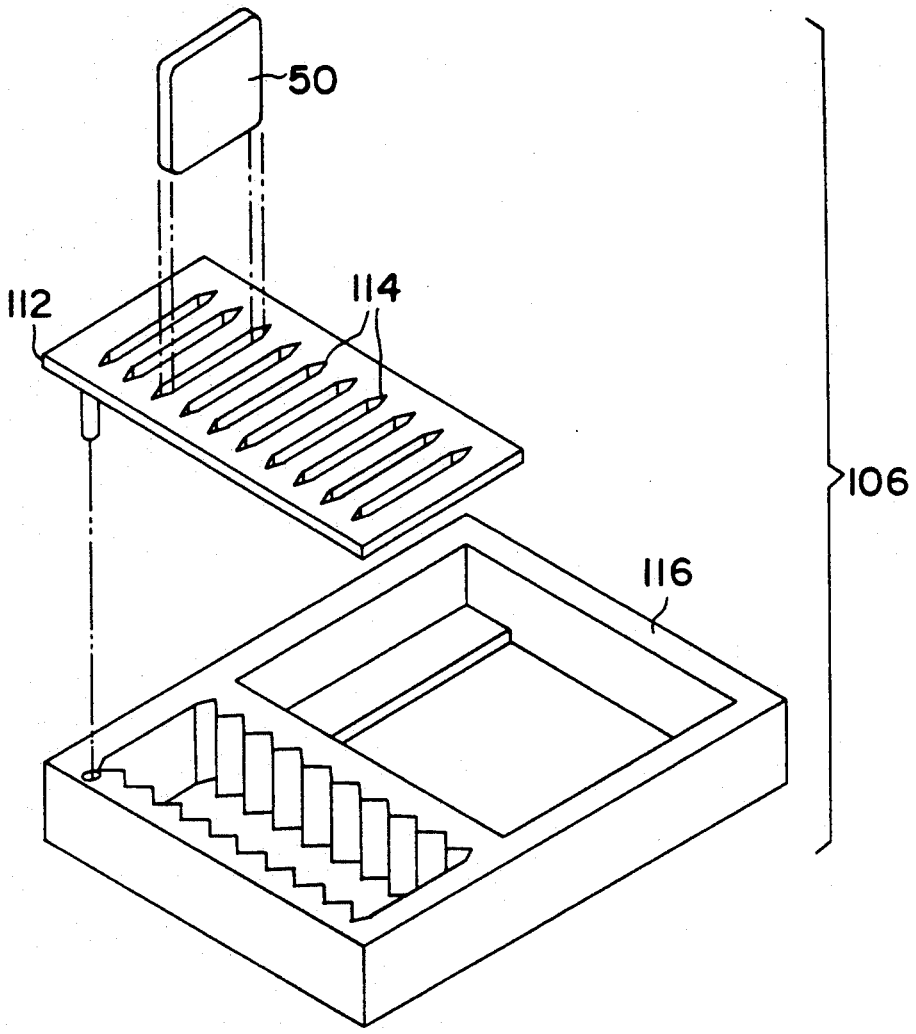
FIG. 2 is an enlarged perspective view of the magazine for the film processor of FIG. 1.

In order to load the film chips 50 into the processor, a rectangularly-shaped receiver 104 for a magazine 106 is provided on the left end of a top member 108 of the transport unit 12. The receiver 104 has a rectangular opening 110 aligned with the vertical entrance passage 20 into the channel. The magazine 106 (FIG. 2) includes a top plate 112 provided with ten parallel slots 114 which are located above the opening 110 in the receiver 104 in alignment with the respective pairs of V-grooves 46 and 48 in the opposing walls of the channel. A gate member 118 located to slide in recesses on the bottom of the magazine 106 is initially moved to a 75% open right-hand position to prevent the film chips 50 from dropping during loading of the magazine.

The gate member 118 is disposed to slide in a recess provided on the underside of the receiver 104. The backside of the gate member 118 has a vertical extension 120 provided with a pin 122. A spring 124 normally holds the gate member 118 toward the left to close the entrance passage 20. With the magazine loaded with film chips 50, the gate member 118 is caused to move to its right-hand position while the pin 128 is being slowly moved manually to the right in slot 130 as more fully described in the aforementioned Zwettler et al. U.S. Pat. No. 4,125,852. With the gate member 118 forced to its extreme right position, the opening 110 is cleared so that film chips 50 stored in the slots 114 of the magazine 106 drop down into the channel. Successive batches of the standard size film chips 50 drop down into the entrance passage 20 of the channel and thence into the first tank 72 from which they are successively transported by the lower and upper lifters 52 and 60 to the tanks 74 and 76, and thence into the roller drive unit 80 in the dryer.

The film chip processor 10 is provided with a cover, generally indicated as 140, including a rectangularly-shaped opening 142 for positioning over the receiver 104 formed on the top member 108 and a rectangularly-shaped slot 144 for receiving a film chip removal magazine, generally indicated as 146, as more fully hereinafter described.

Having described the basic film chip processor 10 and the nature of the loading and movement of the standard size film chips therethrough, reference is now also made to FIGS. 4 to 7 illustrating the improved gear drive assembly 66 for the film transport unit 12. The gear drive assembly 66 is comprised of gears 150 affixed to shafts 64 for rotating the upper lifters 60, intermediate idler gears 152 mounted to shafts 154 and gears 156 mounted to shafts 158. The gears 150, 152 and 156 are driven by drive motor gear pinion 160 mounted in a shaft 162 in meshed interrelationship with the gear 156 proximate the wash tank 76.

Mounted on each shaft 158, outwardly spaced apart from gear 156, there is provided a disc member 164 having radially formed, semi-circular openings 166. A plate 168 including pins 170 is radially mounted about the disc member 164 such that the pins 170 are positioned at the center of each semi-circular opening 166 proximate with the circumference of disc member 164. Mounted on each of shafts 172 extending through the rear wall 14 of the transport unit 12 is an escapement gear 174 referring specifically to FIGS. 4 through 6, comprised of inwardly extending slots 176. The pins 170 engage escapement gear 174 in the slots 176 as more fully hereinafter described.

In operation, counterclockwise rotation of the drive gear 160 about the shaft 162 by motor drive assembly (not shown) effects rotation of the gears 156 as illustrated by the arrows in FIG. 4. Rotation of the gears 156 is continuous with concomitant rotations of the disc member 164 and thus rotation of the laterally-extending pins 170 mounted on disc member 164 referring to FIG. 5. As each pin 170 reaches a lower portion of a cycle, a pin 170 enters a cooperating slot 176 of the escapement gear 174 and thus, with successive two pin contact, engages an interior surface to effect counterclockwise movement of escapement gears 174 for 180° thereby concomitantly rotating the shaft 172. The shaft 172 in the opposite side of the rear wall 14, referring to FIGS. 3 and 7, has mounted thereon a gear 180 in meshed relationship to a gear 184 mounted on the shaft 58 thereby counterclockwise rotating the respective lower lifters 52 by 180°. Thus, the escapement gear 174 is intermittantly rotated in cooperation with the pins 170 formed or disposed on the plate 168 mounted on the disc member 164.

As readily understood, the gears 150 are continuously rotated in a counterclockwise direction in FIG. 4, or a clockwise direction referencing FIG. 3, thereby effecting clockwise rotation of the upper lifters still referring to FIG. 3. The positioning of the upper lifters 60 on the shafts 64 coincide with the position of the lower lifters 52 on the shafts 58 and rotation thereof to effect transfer of the processing film chips 50 from the arm portions 56 of the lower lifters 52 to the arm portions 63 of the upper lifters 60 without contact between such respective arm portions of the lifters.

In accordance with the present invention, the lower lifters 52 are moved at high speed in intermittent manner from position to position thereby permitting longer effective dwell times of the film chips 50 in the respective tanks and allowing increased cross-over arm speed or transfer between the lower lifter 52 via the upper lifter 60 to a succeeding processing tank and eventual drying. The increased crossover (upper arm) speed is enabled because the film chip 50 is moved through the area swept by the upper arm 60 very rapidly by the quick escapement which moves the lower arm 52 at high speed. Thus, each film chip is permitted more uniform leading and trailing edge submerged time with concomitant reduction of dead time or non-submergence compared with the film transport assembly of the prior art. The net results are a reduction in processing times of at least about 40%. There is also a ready capability for programming processing changes with regard to each process vessel by rearrangement of the configuration (location and number) of the pins 170, the orifices 166 where a plurality of (two illustrated) orifices 166 are spaced about the periphery of the disc member 164, and the slots 176.

Figure 8:
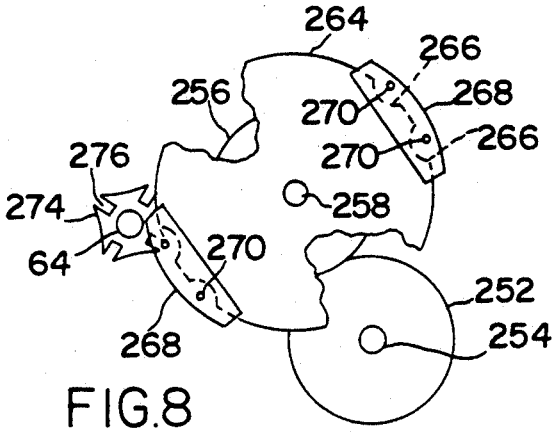
FIG. 8 is a partial rear view of a film transport assembly of another embodiment of the present invention.

FIG. 8 illustrates another embodiment of the present invention wherein the upper lifter 60 arms (one illustrated) are driven at high speed in an intermittent manner. The shaft 64 on which is mounted an upper lifter 60 is provided with an escapement gear 274 including slots 276.

Figure 5:
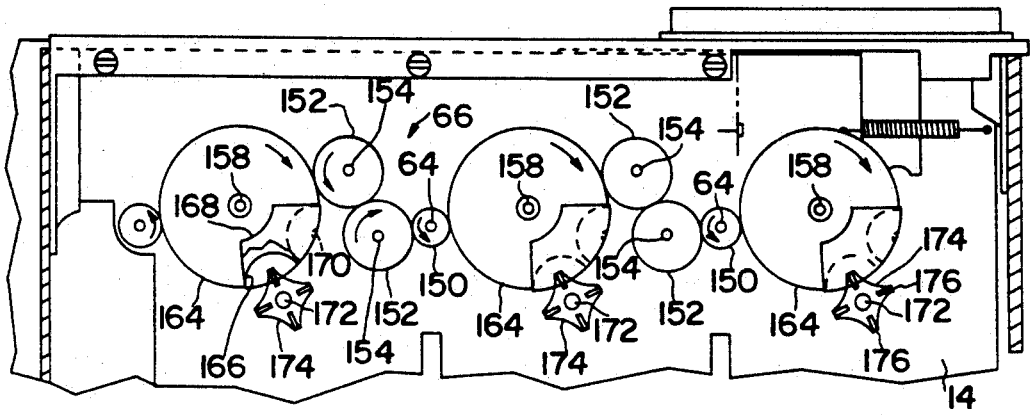
FIG. 5 is a partial elevational view of the film transport.

An intermediate gear 256 mounted on a shaft 258 is in meshed interrelationship with an idler gear 252 mounted on a shaft 254 which are driven by the drive motor gear pinion 160, such as hereinabove described with reference to gear drive assembly illustrated in FIGS. 4 and 5. A disc member 264 including radially formed, semi-circular openings 266 is mounted on the shaft 258 outwardly of the gear 256. Plates 266 including pins 270 are radially mounted about the disc member 264 such that the pins 270 are positioned at the center of each semi-circular opening proximate the circumference of the disc member 264. Operation of the upper lifter arm intermittent gear drive assembly is similar to that of the hereinabove described lower lifter arm intermittent gear drive assembly.

Figure 7:
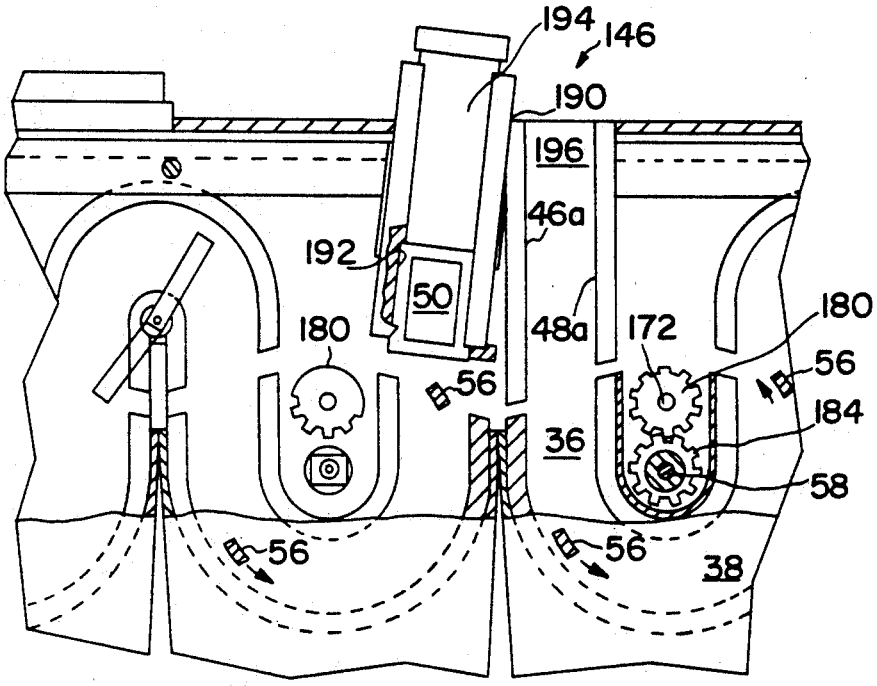
FIG. 7 is a partial cross-sectional view of the film chip withdrawal assembly.

The film processor 10 of the present invention, referring now to FIG. 7, includes a film chip removal magazine 146 to permit selective removal and viewing of preliminarily-developed film, chip 50. The magazine 146 is a rectangularly-shaped member 190 formed with opposite filmed grooves 192 (one shown) in coincident relationship with at least one (1) cooperating pair of grooves 46 and 48 in the channel of the transport unit. The body member 190 is provided with a reciprocating action plunger member 194.

The configuration of the disc member 164 including the openings 166 surrounding a pin 170 nesting into the arched areas of the escapement gear 172 results in a locking assembly to prevent undesired rotation of the shafts of the lifter arm members. Accordingly, such nested configuration prevents the escapement gear from rotating except when the slots 176 of the escapement gear 172 are engaged with a pin 170 on the plate member 168 mounted to the disc member 164 whereby the peaks of the escapement gear 172 are allowed to rotate through the openings 166 of the disc member 164.

Additionally, rotation of the escapement gear 164 may be programmed, as desired by location of the plate member 168, including pins 170 on the disc member 164. The number of plate members 168 and intercenter distances may be permanent, removable or movable. Consequently, the number and location of slots may be chosen to be compatible with a variety of adjustable pin patterns thereby allowing a given set of components to be readily programmed to a variety of sequences, and thus individual portions of the system may be programmed to employ different sequences than other portions of the assembly. Still further, it is possible to produce directional rotation of the escapement gear by reversing the direction of the disc member 164.

In operation, should the user determine that it is necessary to view a preliminarily-developed film chip 50, the assembly 146, with the plunger 194, in a down position, is positioned via the slot 144 into an opening coincident with the V-grooves 46 and 48 such that the rotation of the lower lifter arm 56 causes the film chip 50 to enter the grooves 192 therein concomitantly raising the plunger 194 thereby indicating film chip capture. Thereupon, the magazine 146 is withdrawn from the film processor 10 with the film chip 50 thereby permitting viewing. The thus viewed partially-developed film chip 50 may be returned to the film processor by manually inserting the film chip 50 into a channel 196 formed by cooperating V-grooves **46*a* and 48*a* formed above and in line with V-grooves 46 and 48 of the wash compartment 38** for completion of the film processing including drying.

It will be understood by one skilled in the art that a plurality of plate members 168 including pins 170 may be positioned about the disc plate 164 to provide a variety of processing speeds. Additionally, the film chip dwell times in the paused positions for an extended time with the film chip being rapidly moved, when moved, as a result of rotation of the lifters at high speed during the film chip passing through the area swept by the upper lifter arms while the upper lifter arms are traveling in an area outside the swept area. Such action allows much faster transfer from the submerged position in the tank to the submerged position in the succeeding tanks.

In accordance with the present invention, it is possible to alter the relationship between film motion and timing by use of intermittent motion for any transport elements in combination with or in place of continuous motion. Thus, intermittent motion may be applied to the upper crossover arm member in conjunction with continuous or intermittent motion of the lower arm members to delay entering an area the film chip must transit to reach a transfer point from the lower arm member to the upper arm member until the film chip is past the zone where the upper arm member may strike the side of the film chip. This allows the time necessary for the upper crossover arm member to be a very short time added to the time of the lower arm member pattern where motion of the lower arm may be continuous or intermittent.

Also, since in prior units, the film moves slowly, a great deal of time is taken for the film to exit from the liquid from the time the leading edge breaks the surface to the time the trailing edge reaches the upper lifter arm pickup point. During this time, the effective developing time is much less at the leading edge than it is on the trailing edge. In effect, the mean submerged time is less than the trailing edge submerged time. This has two adverse effects: (1) the total time must be longer to get sufficient developing and clearing; and (2) the developing and clearing is uneven, being greater on the trailing edge and less on the leading edge.

The present invention allows virtually full time of any given film time cycle for the film to be fully submerged. The period between full submergence in tank 1 to full submergence in tank 2 is virtually negligible. Since totally lapsed time between drops is one-half of the cycle time in the developer, the drop interval is considerably reduced as the time cycle is compressed.

While the invention has been described in connection with an exemplary embodiment thereof, it will be understood that many modifications will be apparent to those of ordinary skill in the in the art; and that this application is intended to cover any adaptations or variations thereof. Therefore, it is manifestly intended that this invention be only limited by the claims and the equivalents thereof.

What is claimed:

1. A processor for film chips comprising:

a series of tanks;

transport means including a rear vertical wall having a pair of parallel, spaced walls laterally extending therefrom, said spaced walls having curved portions thereof extending down into and up out of each said tanks and curved portions thereof extending from each tank over into the succeeding tank;

a plurality of laterally-spaced grooves formed on the opposing surfaces of said spaced walls, each groove on one wall associated with a groove on the opposite wall to form a pair of opposing grooves lying in a common vertical plane extending parallel to the plane of said rear vertical wall and forming a plurality of transport paths through the spaced walls for a vertically-oriented film chip;

a lower laterally-extending arm member having a radial member mounted for rotation about an axis disposed normal to the rear vertical wall and extending down into and up out of each of said tanks;

an upper laterally-extending arm member having a radial member mounted for rotation about an axis disposed normal to the rear vertical wall and substantially at the center of each curved portion of the spaced walls extending from a tank over into a succeeding stage of said processor;

each said upper arm member synchronized to rotate with a lower arm member so that when said lower arm member lifts film chips on a transient path out of a tank, said upper arm member continued to lift and transfer film chips into a succeeding stage of the processor; and means for intermittently rotating at least one of said lower or upper arm members.

2. A processor for film chips comprising;

a development compartment;

a series of tanks in said development compartment;

a channel formed of a pair of laterally-extending, parallel spaced walls having lower curved portions extending down into and out of each of said tanks and upper curved portions extending from each tank to the succeeding tank;

a plurality of V-grooves formed on the opposing surfaces of said spaced walls, each V-groove on one wall associated with a V-groove on the opposite wall to form a pair of opposing V-grooves lying in the same vertical plane forming a transport path through the channel for a vertically-oriented film chip;

a lower lifter member mounted for rotation about an axis substantially at the center of each lower curved portion of the channel extending down into and out of each of said tanks to an upper lifter member mounted for rotation about an axis substantially at the center of each upper curved portion of the channel extending from each tank to a succeeding tank, each said upper lifter member timed to rotate with a lower lifter member so that when said lower lifter member lifts film chips along a transport path out of a tank, said upper lifter member continues to lift and transfer film chips into a succeeding stage of the processor; and means for intermittently rotating at least one of said lower or upper lifter members.

3. The film chip processor as defined in claim 1 and further including:

an upper gear associated with each upper lifter:

an escapement wheel associated with each lower lifter;

a drive assembly gear for each escapement wheel;

intermediate idler gears coupled to said upper gear and drive assembly gear; and a power gear coupled to engage said gears.

4. The film chip processor as defined in claim 3 wherein said escapement wheel includes slots and is assembled on a shaft having a gear in threaded contact with a gear on a shaft for said lower lifter and wherein said drive assembly includes pins for engaging slots of said escapement wheel.

5. The film chip processor as defined in claim 4 wherein said drive assembly is comprised of an idler gear in threaded contact with said intermediate idler gears and a plate member mounted on said shaft of said idler gear of said drive assembly and having said pin mounted on a plate member mounted on the disc.

6. The film chip processor as defined in claim 5 wherein said escapement wheel includes quadrantly disposed slots and where said plate member is formed with two pin members successively engaging slots of said escapement wheel to thereby rotate said lower lifters 180°.

7. The film processor as defined in claim 2 and further including:

an upper gear associated with each lower lifter member;

an escapement wheel associated with each upper lifter member;

a drive assembly gear for each escapement wheel;

intermediate idler gears coupled to said upper gear and drive assembly gear; and a power gear coupled to engage said gears.

8. The film chip processor as defined in claim 7 wherein said escapement wheel includes slots and is assembled on a shaft having a gear in threaded contact with a gear on a shaft for said lower lifter member and wherein said drive assembly includes pins for engaging slots of said escapement wheel.

9. The film chip processor as defined in claim 8 wherein said drive assembly is comprised of an idler gear in threaded contact with said intermediate idler gears and a plate member mounted on said shaft of said idler gear of said drive assembly and having said pin member mounted on a plate mounted on a disc.

10. The film processor as defined in claim 9 wherein said escapement wheel includes quadrantly disposed slots and where said plate member is formed with two pin members successively engaging slots of said escapement wheel to thereby rotate said lower lifters 180°.

11. A processor for film chips comprising;

a series of tanks;

transport means including a rear vertical wall having a pair of parallel, spaced walls laterally extending therefrom, said spaced walls having curved portions thereof extending down into and up out of each said tanks and curved portions thereof extending from each tank over into the succeeding tank;

a plurality of laterally-spaced grooves formed on the opposing surfaces of said spaced walls, each groove on one wall associated with a groove on the opposite wall to form a pair of opposing grooves lying in a common vertical plane extending parallel to the plane of said rear vertical wall and forming a plurality of transport paths through the spaced walls for a vertically-oriented film chip;

a lower laterally-extending arm having a radial member mounted for rotation about an axis disposed normal to the rear vertical wall and extending down into and up out of each of said tanks;

an upper laterally-extending arm having a radial member mounted for rotation about an axis disposed normal to the rear vertical wall and extending from a tank over into a succeeding tank, each said upper arm synchronized to rotate with a lower arm so that when said lower arm lifts film chips on a transport path out of a tank, said upper arm continues to lift and transfer film chips into succeeding tank; and magazine means for withdrawing a film chip from a transport path prior to passage to a succeeding tank.

12. The processor as defined in claim 11 wherein said magazine means for withdrawing a film chip is inserted within the transport path of cooperating grooves before a last tank.

13. The processor as defined in claim 9 and further including an orifice for inserting a film chip into said transport path.

14. The processor as defined in claim 7 wherein said magazine means for withdrawing a film chip is a rectangulary-shaped plate member having cooperating grooves corresponding to cooperating grooves of said transport path.

15. The processor as defined in claim 14 wherein said plate member includes a rod member for reciprocating movement between a closed position and an open position wherein in said open position, said rod member indicates capture of a film chip.

16. The processor as defined in claim 15 wherein said magazine means for withdrawing a film chip is positioned in an upper curved portion of said transport path between successive tanks.

17. The processor as defined in claim 16 wherein said magazine member is positioned in a rising section of said upper curved portion of said transport path.

18. The processor as defined in claim 11 and further including an orifice for inserting a film chip into said transport path.

19. The processor as defined in claim 12 and further including an orifice for reinserting a withdrawn film chip into said transport path prior to said last tank.

* * * * *

UNITED STATES PATENT AND TRADEMARK OFFICE

CERTIFICATE OF CORRECTION

PATENT NO. : 5,241,339

DATED : Aug. 31, 1993

INVENTOR(S) : William J. Maroney

It is certified that error appears in the above-indentified patent and that said Letters Patent is hereby corrected as shown below:

On title page, item [19] should read --Maroney-- and
item [75] "William J. Marany" should read --William J. Maroney--

Signed and Sealed this

Fifth Day of July, 1994

Bruce Lehman

*Attest:*

BRUCE LEHMAN

*Attesting Officer*

*Commissioner of Patents and Trademarks*